US008388297B2

(12) United States Patent
Holloway

(10) Patent No.: US 8,388,297 B2
(45) Date of Patent: Mar. 5, 2013

(54) COIL DOWNENDER

(75) Inventor: Ward M. Holloway, Barre, MA (US)

(73) Assignee: Siemens Industry, Inc., Alpharetta, GA (US)

( * ) Notice: Subject to any disclaimer, the term of this patent is extended or adjusted under 35 U.S.C. 154(b) by 495 days.

(21) Appl. No.: 12/694,401

(22) Filed: Jan. 27, 2010

(65) Prior Publication Data

US 2011/0182711 A1 Jul. 28, 2011

(51) Int. Cl.
*B21C 47/24* (2006.01)

(52) U.S. Cl. ..... 414/777; 269/61; 414/778

(58) Field of Classification Search ..... 269/152, 269/61; 414/360–361, 576, 581, 758–759, 414/761–767, 769, 774, 777, 779, 784, 362, 414/371, 640, 919
See application file for complete search history.

(56) References Cited

U.S. PATENT DOCUMENTS 279,868 A * 6/1883 Hall ..... 414/362
400,049 A * 3/1889 Bryant ..... 414/371
1,266,094 A * 5/1918 Beckman ..... 269/61
2,146,893 A * 2/1939 Gottardt ..... 414/777
3,206,049 A 9/1965 Dube
3,212,658 A * 10/1965 Roberts ..... 414/784
3,373,829 A * 3/1968 Suman et al. ..... 177/132
3,753,505 A 8/1973 Ouska
3,796,329 A * 3/1974 Ouska ..... 414/361
3,868,101 A * 2/1975 Nozaki et al. ..... 269/25
4,056,186 A * 11/1977 Hill ..... 100/12
5,567,105 A * 10/1996 Williams ..... 414/360
5,735,477 A 4/1998 Puchovsky Melicher

OTHER PUBLICATIONS

PCT International Search Report mailed Jul. 31, 2012 corresponding to PCT International Application No. PCT/US2011/020103 filed Jan. 4, 2011 (10 pages).

* cited by examiner

*Primary Examiner* — Gregory Adams

(57) ABSTRACT

An apparatus is disclosed for downending a vertically disposed cylindrical coil supported on an underlying pallet, with a stem projecting from the pallet through the coil. The apparatus comprises a cradle rotatable about a horizontal axis. A table on the cradle is configured and arranged to receive and retain the pallet with the coil in a vertical first position at which the coil extends across the horizontal axis. An electrically powered drive serves to rotate the cradle about the horizontal axis to translate the coil from its vertical first position to a horizontal second position.

9 Claims, 6 Drawing Sheets

COIL DOWNENDER

BACKGROUND DISCUSSION

1. Field of the Invention

This invention relates generally to material handling equipment, and is concerned in particular with the provision of a novel and improved downender for use in a rolling mill to translate cylindrical coils of hot rolled products from vertical to horizontal positions.

2. Description of the Prior Art

In the typical rolling mill downender, the axis of the coil does not extend across the axis of rotation about which the coil is translated from a vertical to a horizontal position. This increases the offset of the center of gravity of the coil from the axis of rotation, which in turn increases the power required to effect coil translation. In order to satisfy this increased power demand, equipment designers have conventionally resorted to the use of hydraulic linear actuators, which occupy considerable space and require expensive associated components, including hydraulic pumps, piping, and circuitry.

The objective of the present invention is to provide an improved downender in which the coil axis extends across the rotational axis about which the coil is translated, thereby advantageously positioning the coil center of gravity closer to the downender's rotational axis. This in turn reduces power requirements and makes it possible to employ less complicated and less expensive electrically powered drive components.

SUMMARY OF THE INVENTION

Broadly stated, the present invention comprises an apparatus for downending a vertically disposed cylindrical coil supported on an underlying pallet, with a stem projecting from the pallet and extending axially through the coil. The apparatus includes a cradle rotatable about a horizontal axis. A table on the cradle is configured and arranged to receive and retain the pallet with the coil in a vertical first position at which the coil axis extends across the horizontal rotational axis of the cradle. An electrically powered drive serves to rotate the cradle about its horizontal axis to translate the coil from its vertical position to a horizontal position.

These and other features and their attendant advantages will now be described in greater detail with reference to the accompanying drawings, wherein:

DETAILED DESCRIPTION

Figure 1:
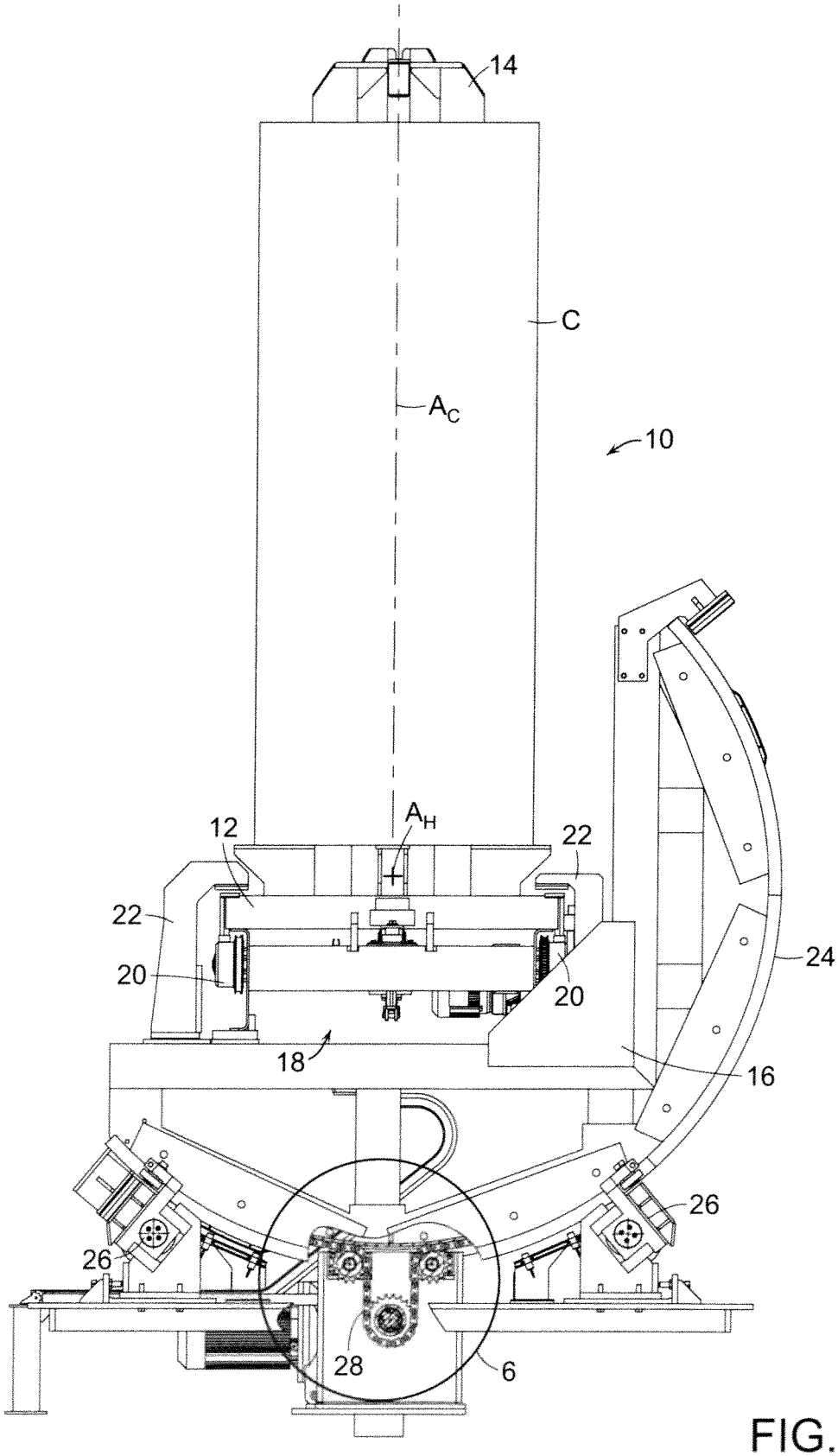
FIG. 1 is a side elevational view of a downender in accordance with the present invention, with a coil supported in a vertical first position.

Referring now to the drawings, an apparatus for downending a vertically disposed cylindrical coil "C" is shown at 10. The coil is supported on an underlying pallet 12, with a stem 14 projecting upwardly from the pallet and axially through the coil.

The apparatus includes a cradle 16 rotatable about a horizontal axis "$A_H$". A table 18 on the cradle includes rollers 20 on which the pallet 12 is received along axis $A_H$. Hook-shaped brackets 22 serve to retain the pallet 12 on the table rollers 20, with the coil in a first vertical position at which the coil axis $A_C$ extends across the horizontal axis $A_H$, thus aligning the center of gravity of the coil with axis $A_H$.

The cradle is provided with at least one and preferably two partially circular tracks 24 arranged concentrically with respect to axis $A_H$. The tracks 24 are supported on stationary bearings 26 for rotation about axis $A_H$. As can best be seen in FIG. 3, the tracks 24 are parallel and spaced one from the other along axis $A_H$, with the table 18 located between the tracks.

Figure 2:
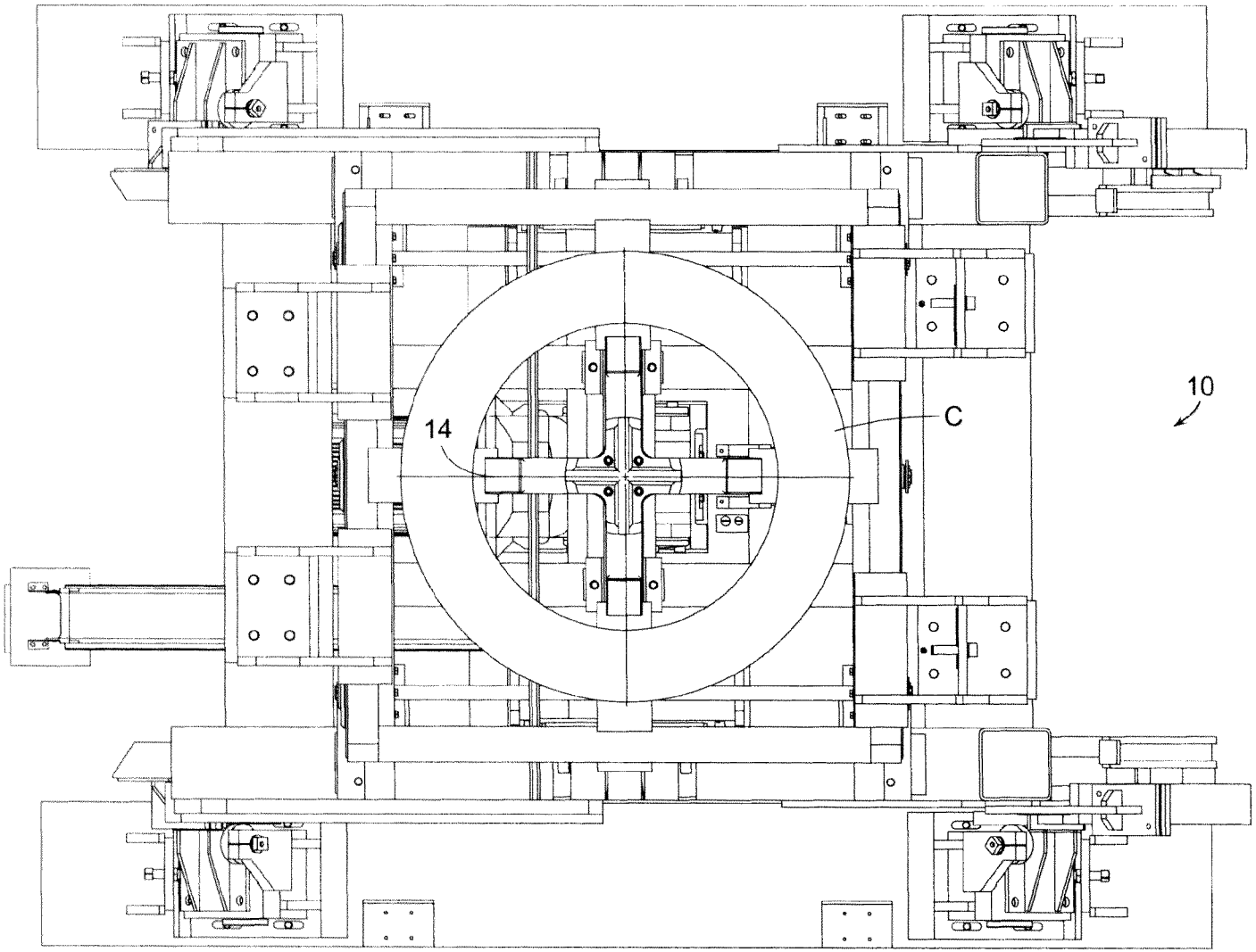
FIG. 2 is a top plan view of the downender.
Figure 3:
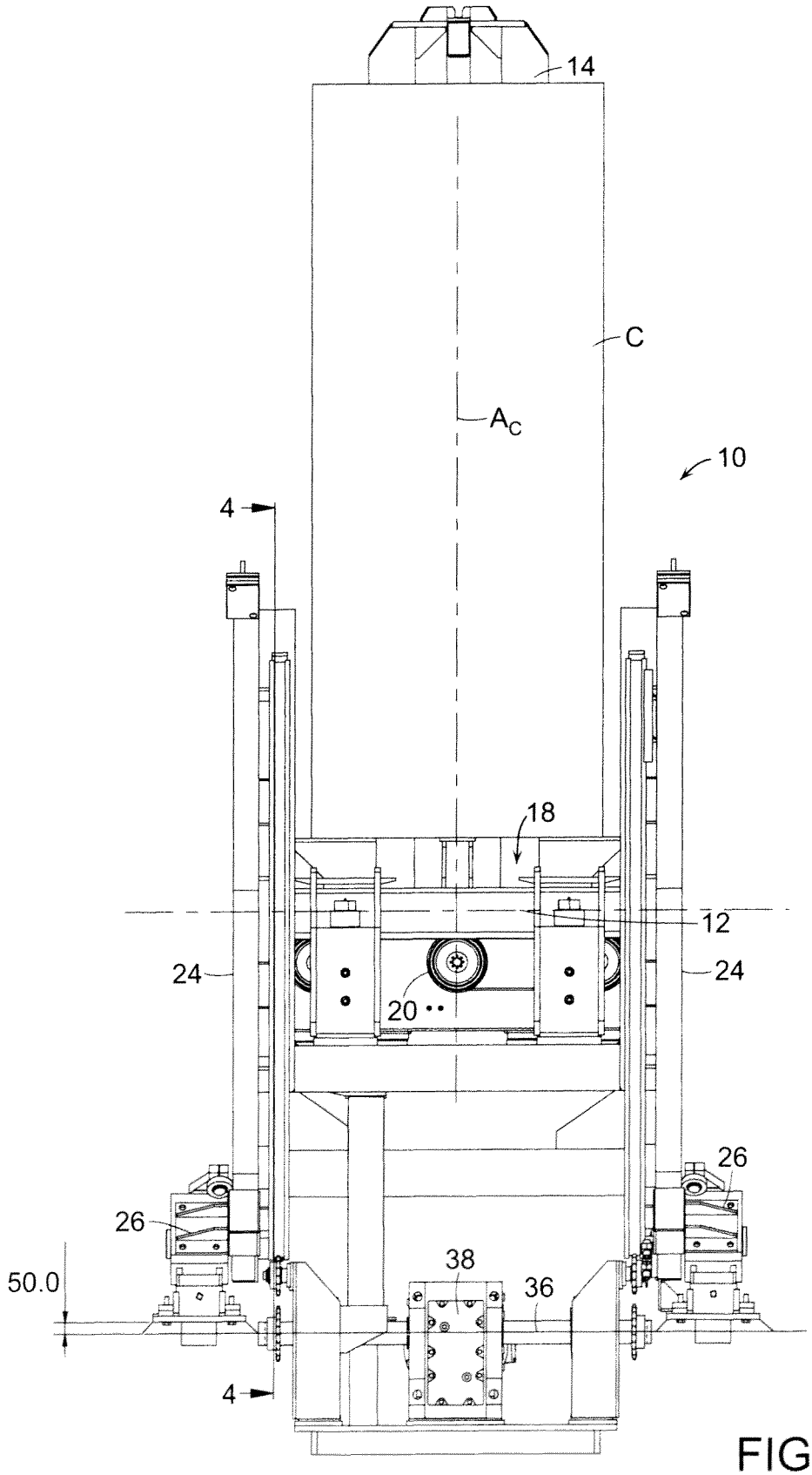
FIG. 3 is an end view of the downender.
Figure 4:
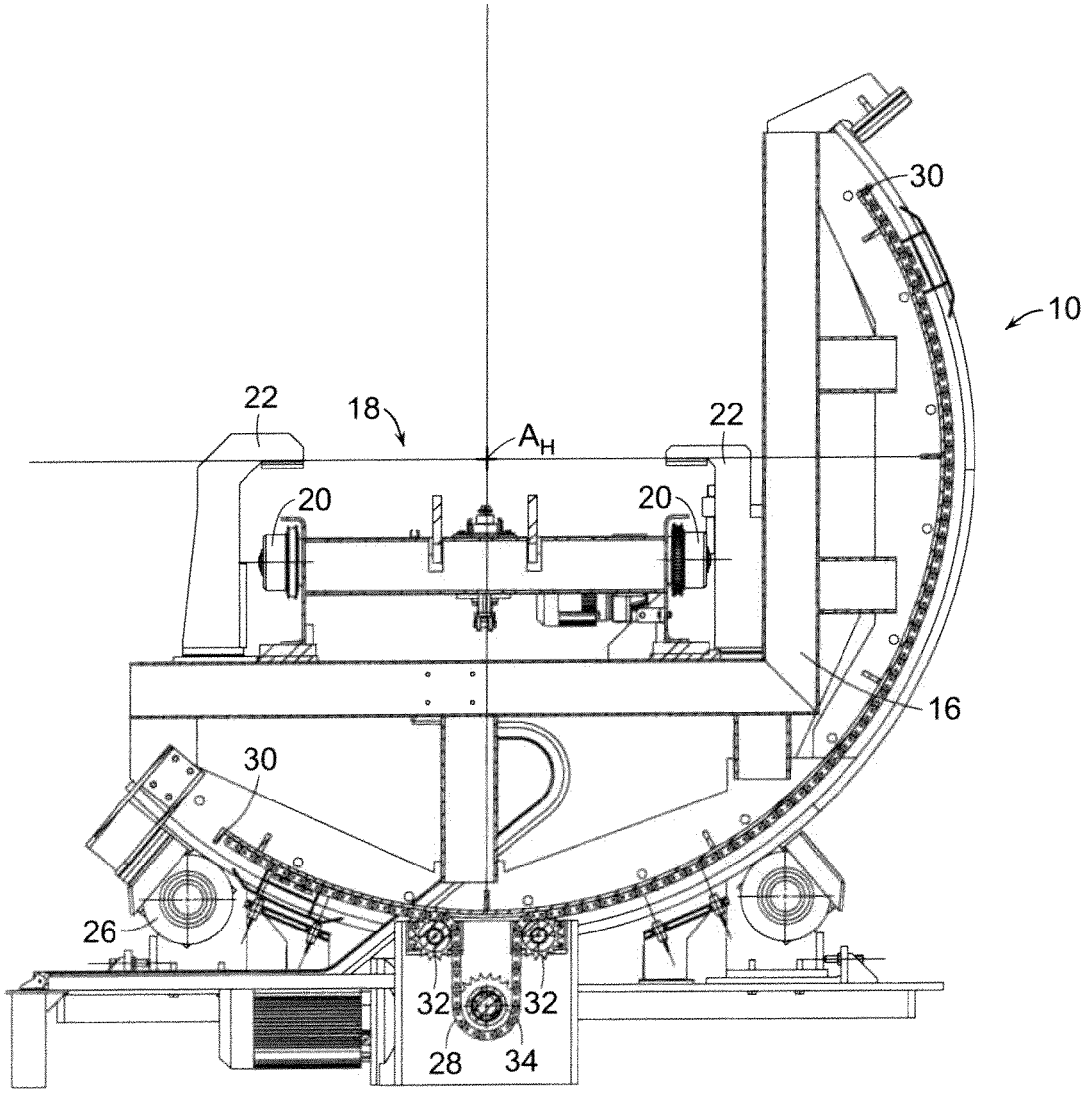
FIG. 4 is a sectional view taken on line 4-4 of FIG. 3.
Figure 5:
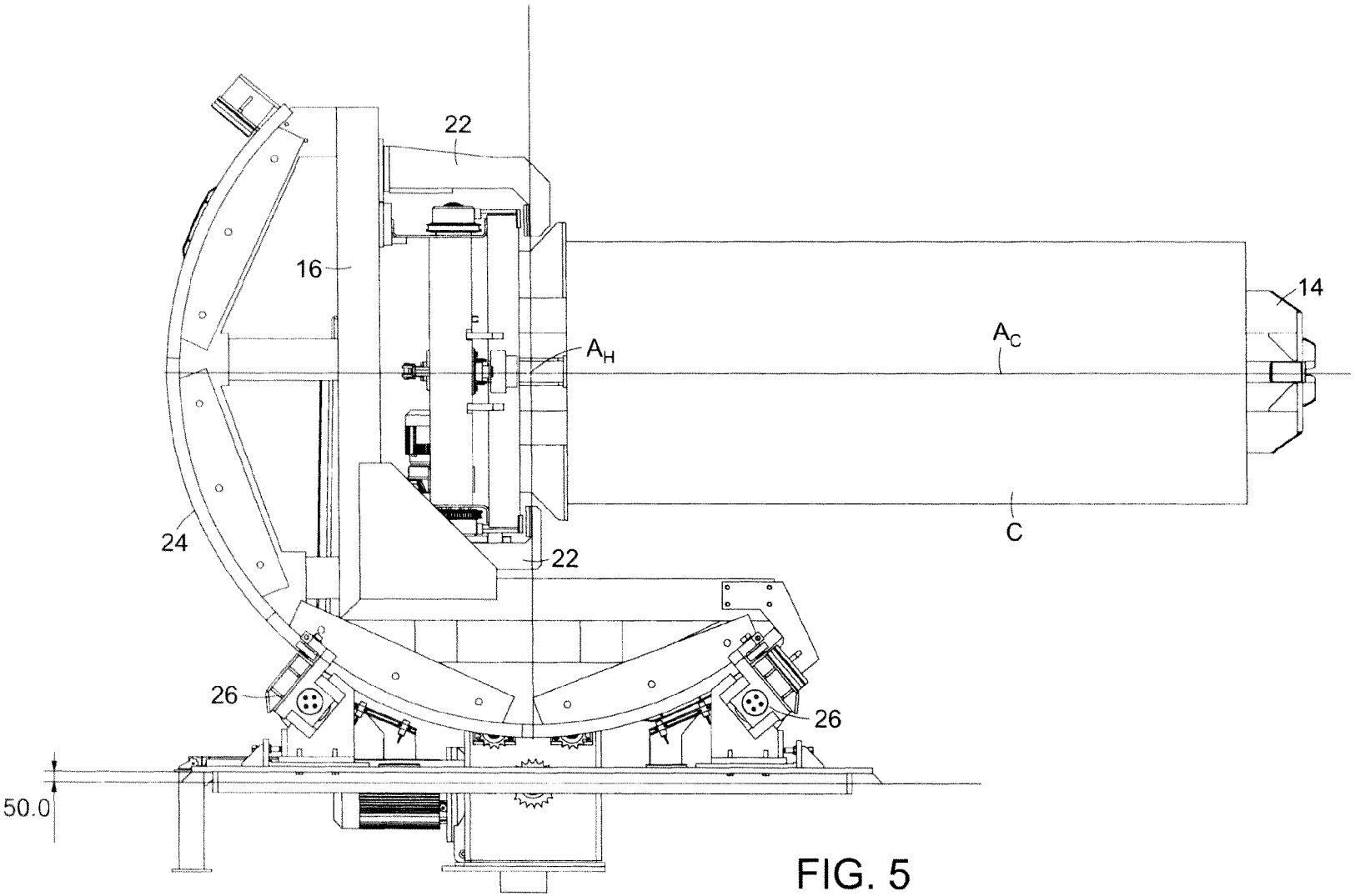
FIG. 5 is a view similar to FIG. 1 showing the coil downended to a horizontal second position.

An electrically powered drive serves to rotate the cradle about axis $A_H$ in order to translate the coil from its vertical first position as shown in FIGS. 1-3, to a horizontal second position as shown in FIG. 5. The drive comprises chains 28 of finite length extending around the tracks 24, with the opposite ends of the chains fixed as at 30 with respect to the tracks.

Figure 6:
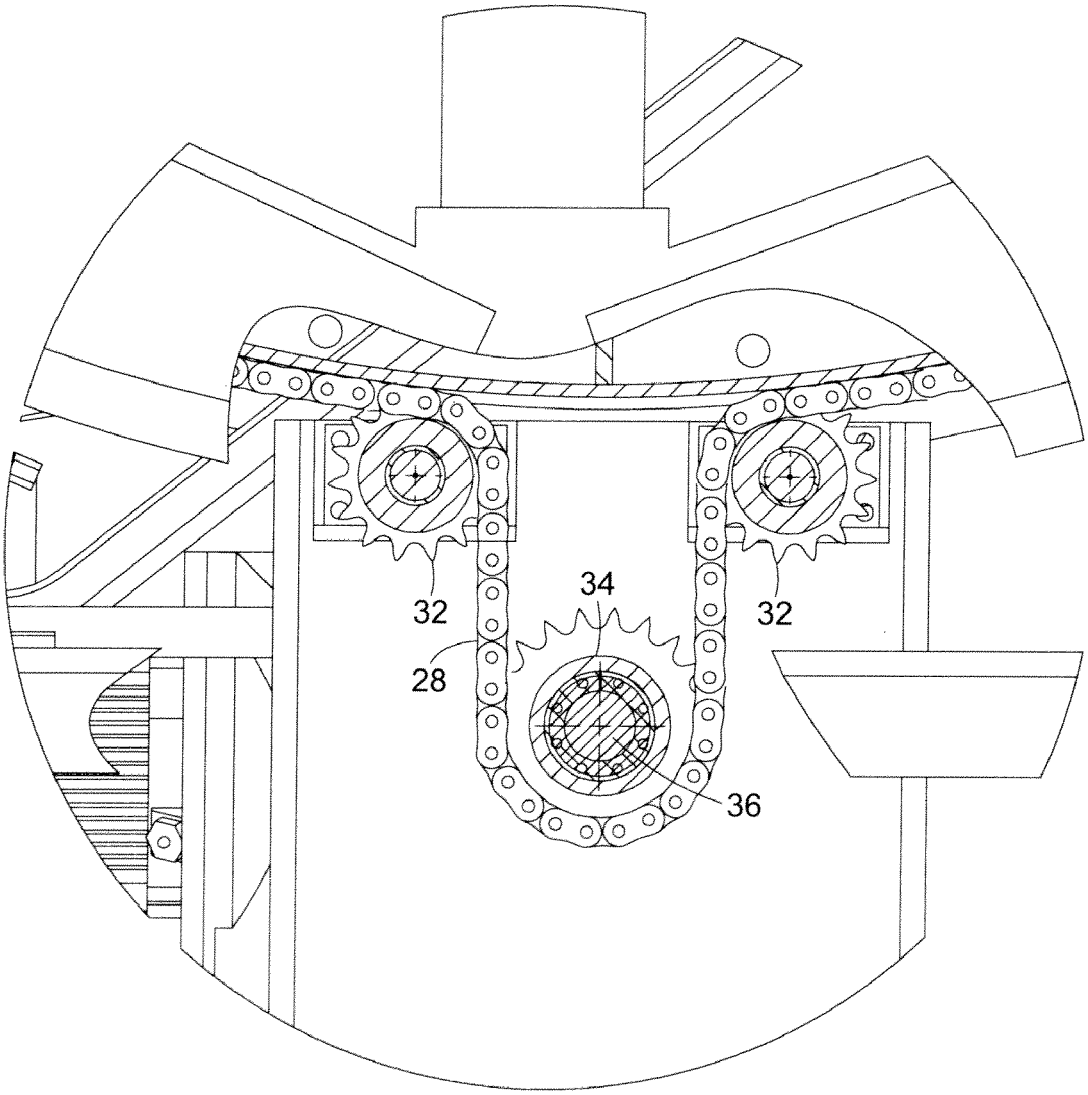
FIG. 6 is an enlarged view of the circled portion shown in FIG. 1.

As can best be seen in FIG. 6, a segment of each chain 28 extends over idler sprockets 32 and around a drive sprocket 34. As shown in FIG. 3, the drive sprockets 34 of the chains 28 are supported on a common shaft 36 driven by an electrically powered gear motor 38.

In light of the foregoing, it will now be understood by those skilled in the art that by initially positioning the coil C with its axis $A_C$ extending across axis $A_H$, thus aligning the center of gravity of the coil with axis $A_H$, the power required to rotate the coil to the horizontal position shown in FIG. 5 is less than the power that would be required to do so if the coil axis $A_C$ did not extend across axis $A_H$. This reduced power requirement makes it possible to employ a more compact and less expensive electrically powered drive.

The foregoing description has been set forth to illustrate the invention and is not intended to be limiting. Since further modifications of the described embodiments incorporating the spirit and substance of the invention may occur to persons skilled in the art, the scope of invention should be limited solely with reference to the appended claims and equivalents thereof.

What is claimed is:

1. Apparatus for downending a vertically disposed cylindrical coil supported on an underlying pallet, with a stem projecting from the pallet through the coil, said apparatus comprising:

a cradle rotatable about a horizontal axis, said cradle having at least one partially circular track arranged concentrically with respect to said horizontal axis, said track being supported on stationary bearings for rotation about said horizontal axis;

a table on said cradle, said table being configured and arranged to receive and retain said pallet with said coil in a vertical first position above said horizontal axis and at which the coil axis extends across said horizontal axis; and drive means for rotating said cradle about said horizontal axis to translate said coil from said vertical first position to a horizontal second position;

wherein said drive means comprises a chain of finite length extending around said track, with opposite ends of said chain fixed with respect to said track, and with a segment of said chain between the chain ends being engaged by a sprocket, whereby rotation of said sprocket will result in rotation of said track and said cradle about said horizontal axis.

2. The apparatus of claim 1 wherein said sprocket is electrically driven.

3. The apparatus of claim 1 wherein two of said circular tracks are arranged in parallel planes, with said table being located between said tracks.

4. The apparatus of claim 1 wherein said table is a roller table on which said pallet is received along said horizontal axis.

5. The apparatus of claim 4 further comprising means for retaining said pallet on said roller table during translation of said coil from said vertical first position to said horizontal second position.

6. The apparatus of claim 3 wherein said table is a roller table on which said pallet is received along said horizontal axis.

7. The apparatus of claim 6 further comprising means for retaining said pallet on said roller table during translation of said coil from said vertical first position to said horizontal second position.

8. Apparatus for downending a vertically disposed cylindrical coil supported on an underlying pallet, with a stem projecting from the pallet through the coil, said apparatus comprising:

a cradle rotatable about a horizontal axis, said cradle having a pair of partially circular tracks arranged concentrically with respect to and spaced one from the other along said horizontal axis;

a table positioned on said cradle between said tracks, said cradle being configured and arranged to receive and retain said pallet with said coil in a vertical first position above said horizontal axis and at which the coil axis extends across said horizontal axis; and drive means for rotating said cradle about said horizontal axis to translate said coil from said first position to a horizontal second position, said drive means comprising chains of finite length extending around said tracks, with opposite ends of said chains fixed with respect to their respective tracks, and with segments of said chains between said ends being engaged by sprockets, whereby rotation of said sprockets will result in rotation of said tracks and said cradle about said horizontal axis.

9. The apparatus of claim 8 wherein said sprockets are carried on a common shaft driven by an electrically powered motor.

* * * * *